United States Patent [19]

Garber

[11] Patent Number: 4,584,735

[45] Date of Patent: Apr. 29, 1986

[54] DUSTPAN WITH A CONTROL HANDLE

[75] Inventor: Hyman Garber, Greenlawn, N.Y.

[73] Assignee: Lambro Industries, Inc., Amityville, N.Y.

[21] Appl. No.: 658,755

[22] Filed: Oct. 9, 1984

[51] Int. Cl.[4] ..... A47L 13/52

[52] U.S. Cl. ..... 15/257.7; 294/1.4; 294/53.5

[58] Field of Search ..... 294/51, 52, 53.5, 55, 294/1.4, 1.5; 15/257.1, 257.4, 257.7

[56] References Cited

U.S. PATENT DOCUMENTS

| | | | |
|---|---|---|---|
| 535,372 | 3/1895 | Hebden | 15/257.7 |
| 844,168 | 2/1907 | Murray | 15/257.7 X |
| 916,767 | 3/1909 | Ogden | 15/257.7 |
| 1,570,189 | 1/1926 | Sturm | 294/51 |
| 1,741,004 | 12/1929 | Wornstaff | 294/53.5 |
| 2,699,050 | 1/1955 | MacKay | 294/53.5 X |

FOREIGN PATENT DOCUMENTS

| | | | |
|---|---|---|---|
| 42165 | 5/1930 | Denmark | 294/53.5 |
| 1332021 | 6/1963 | France | 15/257.4 |

*Primary Examiner*—Johnny D. Cherry
*Attorney, Agent, or Firm*—Bauer & Amer

[57] ABSTRACT

In a dustpan pivotally attached to an end of a handle, and latched to extend laterally thereof and unlatched to cause discharge therefrom as the dustpan assumes a vertically extending position, the improvement consisting of moving the latching pin, rather than the pin-engaging hooks of the pan. Thus, this pin movement is advantageously used not only during unlatching of the pan, but also during the latching in place thereof, which greatly simplifies the construction and operational mode of the dustpan.

1 Claim, 5 Drawing Figures

DUSTPAN WITH A CONTROL HANDLE

The present invention relates generally to control handle-operated dustpans, such as described and illustrated in U.S. Pat. No. 2,699,050, and more particularly to improvements which facilitate the position control that is exercised over the dustpan by its control handle.

It is useful that a dustpan assume a horizontally oriented position when refuse is being swept therein, and then undergo a pivotal traverse into a vertical orientation to cause the discharge of its contents. The vertical position also requires much less space and is therefore desired for storage of this product. Thus, two position dustpans, as just described, are well known, and although generally satisfactory, since obviously their construction and operational mode are so simple, there are nevertheless significant improvements provided by the inventive changes proposed herein, all as will be described subsequently in greater detail.

A dustpan for which the within improvements are proposed is of the type in the operation of which a dustpan is pivotally connected adjacent a lower end of a control handle and is selectively latched to extend laterally of said control handle during use, and is unlatched to extend vertically thereof to discharge said dustpan and also to facilitate the storage thereof. The improvements which demonstrate objects and advantages of the present invention include an upwardly spring-biased latching pin having an operative position oriented laterally of the lower end of the control handle, and thus a position in which the opposite ends thereof protrude from the handle. A pin-engaging hook means on the pivotally mounted dustpan is adapted in the laterally extending operative position of the dustpan to latch about the protruding opposite ends of the latching pin. Completing the essential construction is a control rod means in the control handle adapted to be actuated through descending movement at an upper end and in contact at its opposite lower end with the latching pin, so that said descending movement imparted thereto disengages the latching pin from the dustpan hook means. In response to this disengagement, the weight of the laterally extended dustpan causes a pivotal traverse therein and provides for both its discharge and its achieving its storage position. Moreover, the subsequent release of the control rod causes the return thereof and of the latching pin to their original positions under spring urgency.

The above description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

It is already well known, as exemplified by prior U.S. Pat. No. 2,699,050, which by this reference is incorporated in its entirety herein, to provide a dustpan with a control handle. As described in the referenced patent, the dustpan extends laterally of the control handle when being used as a receptacle for refuse and the like, said laterally extending operative position usually being achieved by latching the dustpan in place. The other operative position is one in which the dustpan extends vertically of the control handle and results when the dustpan is unlatched, thus causing it both to discharge its refuse contents and also to assume a more suitable condition for storage, in which it occupies an optimum minimum amount of space. In accordance with the present invention, improvements are embodied in the described control handle-operated dustpan which greatly facilitates providing it with its two operative positions and for effectuating the latching and unlatching of the dustpan as it moves between its two operative positions.

Figure 1:
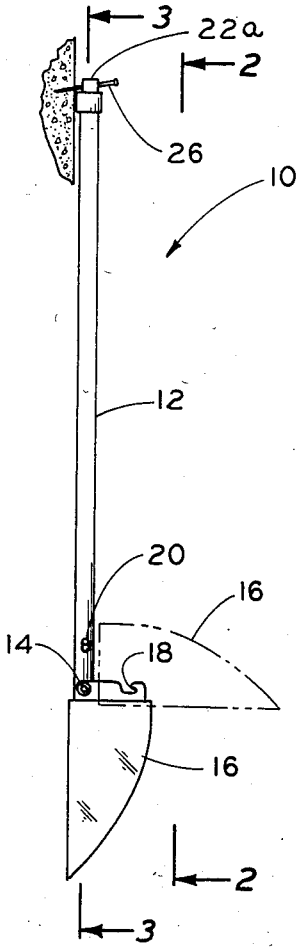
FIG. 1 is a side elevational view of the improved dustpan hereof in which its two operative positions are shown in full line and phantom line perspective.
Figure 2:
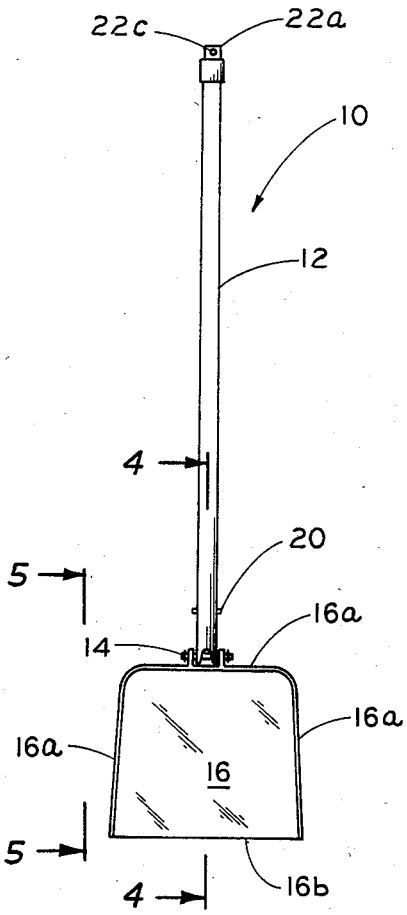
FIG. 2 is a front elevational view as taken along lines 2—2 of FIG. 1 illustrating the stored position of the dustpan as well as additional structural features thereof.
Figure 5:
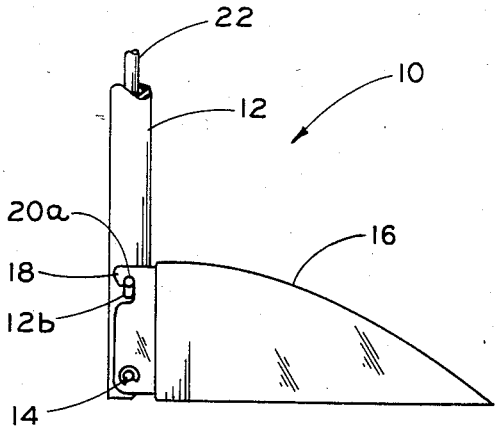
FIG. 5 is a view similar to FIG. 4, taken along lines 5—5 of FIG. 2 and illustrating the dustpan in its laterally extending operative position.

More particularly, and as illustrated in the drawings, the dustpan, generally designated 10, includes a hollow elongated control handle 12 which has pivotally mounted at its lower end, as at 14, the pan per se. That is, the pan 16 has the usual back and side edges, individually and collectively designated **16*a* which cooperate to form a container for refuse which is swept into the pan 16 over a front edge 16*b*. During use of the dustpan 10 to collect refuse as just described, the position of the pan 16 is one in which it extends laterally on the control handle 12, such position being illustrated in phantom perspective in FIG. 1 and in full line perspective in FIG. 5**.

Figure 3:
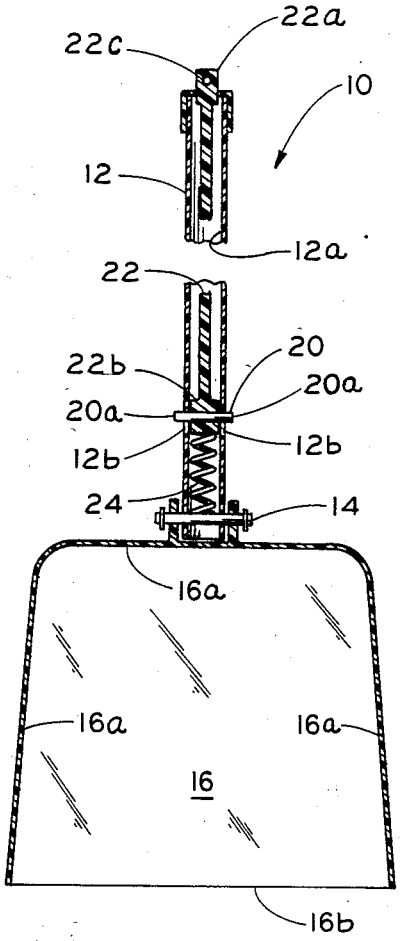
FIG. 3 is a view similar to FIG. 2, but on an enlarged scale, and in section taken long line 3—3 of FIG. 1 so as to better illustrate internal structural features of the dustpan.

Said laterally extending operative position of the pan 16 is achieved using spaced apart hook-like projections 18 formed on the rear of the pan 16 which, as may best be appreciated from FIG. 3, are adapted to engage each opposite end **20*a*, which protrudes from opposite sides of the handle 12, of a latching pin 20. That is, the pan 16, which is mounted for pivotal traverses about the pivot 14 has its pair of hooks 18 positioned to align with and engage the pin ends 20*a* when the pan 16 is urged through a pivotal traverse into its laterally extending operative position. Naturally, as a result of the engagement between the pin 20 and hooks 18, the pan 16 is latched in its operative position as noted in FIGS. 1 and 5**.

Figure 4:
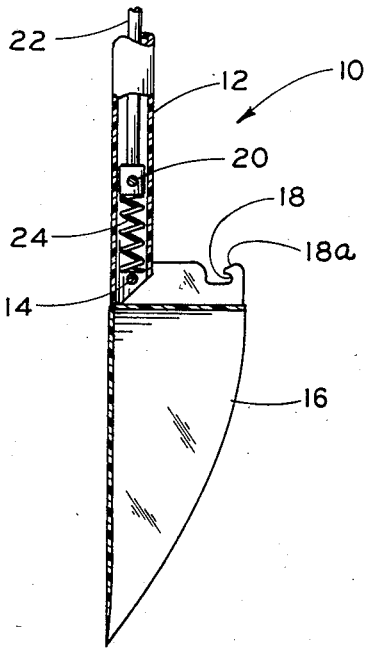
FIG. 4 is a partial sectional view, as taken along line 4—4 of FIG. 2, showing details of the construction of the lower end of the dustpan.

To unlatch the pan 16, and unlike the prior art and particularly that illustrated and described in prior U.S. Pat. No. 2,699,050, the hook means, such as hook 18, is not withdrawn from about the locking or latching pin 20, but rather the reverse occurs in the operation of the within improved dustpan 10. More particularly, and as perhaps may be best appreciated from FIGS. 3 and 4, disposed for sliding movement within the hollow handle 12 is a control rod 22, the upper end of which protrudes from the top of the handle 12 and provides a downwardly depressible button **22*a*. At its opposite or lower end, the control rod 22 is formed somewhat like a piston 22*b* in that it is sized and functions so as to slide freely within the hollow compartment 12*a* of the control handle 12. Disposed in a friction fit through a horizontally oriented opening in the control rod lower end 22***b* is the previously referred to latching pin 20 having its opposite ends 20*a* protruding from opposite sides of the handle 12 through elongated slots or openings 12*b* in the handle. (See in particular FIG. 5.)

Completing the construction and providing an essential upward spring bias to the control rod 22 is a helical spring 24 strategically located in the lower portion of the hollow interior 12*b* of the handle 12, one end of the spring 24 being seated on the pivot pin 14 and the opposite end against the piston or lower end 22*b* of the control rod. As a result, the control rod 22 is under an upward spring urgency or bias which projects its upper button 22*a* in protruding fashion from the handle 12, and thus making it readily accessible to be depressed when urging the control rod 22 through descending movement. As a result of such descending movement, the latching pin 20, and thus the ends 20*a* thereof, move to the bottom of the slot 12*b*, and thus result in the disengagement or unlatching of the pan 16. Once the pin ends 20*a* clear the hook 18, the weight of the laterally extending pan 16 and any refuse therein, urges the pan 16 through a pivotal traverse which not only causes a discharge of the refuse but also provides the pan 16 with its vertically extending position which is more suitable for storage. Thereafter, when button 22 is released, spring 24 restores latching pin 20 as well as the button end 22*a* of the control rod 22 to their original positions. An appropriate opening 22*c* in the button 22*a* is provided for suspending the dustpan 10 in a vertical position on a support wall or the like, as is illustrated at 26 in FIG. 1.

Not only does the spring 24 control sliding movement of the control rod 22 within the handle 12 and, as such, allows for the descending movement thereof during the unlatching of the pan 16, but the spring 24 also favorably contributes to achieving the latching of the pan 16 in its operative laterally extending position. To this end, and as perhaps may be best appreciated from FIG. 4, the hook 18 includes a camming surface 18*a* which, if there is a slight misalignment between any pin end 20*a* and cooperating hook 18, is the first surface to make contact against the pin end 20*a*. In response to this initial contact, latching pin 20 is cammed downwardly, a movement which is permitted by a slight compressing of the spring 24, so that the ends 20*a* can then easily slip under and behind the hooks 18, thus latching the pan 16 in its operative laterally extending position.

From what has been described, it should be readily appreciated that the dustpan 10 hereof is characterized by a greatly simplified construction and a noteworthy mode of operation in which the latching pin, rather than the hook which engages same, is moved in order to produce latching and unlatching of the pan portion of the dustpan. A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. In a dustpan with a control handle of the type in the operation of which a dustpan pivotally connected adjacent a lower end of a control handle is selectively latched to have a first position extending laterally of said control handle during use and is unlatched to have a second position extending vertically thereof to discharge said dustpan and to facilitate the storage thereof, the improvements comprising said control handle having a hollow interior and slots on opposite sides adjacent the lower end thereof, a control rod operatively disposed for sliding movement in said hollow handle, a latching pin having an operative position oriented laterally of and attached to said lower end of said control rod with opposite ends thereof protruding from said slots of said control handle, a pin-engaging hook on said pivotally mounted dustpan adapted in said first laterally extending position of said dustpan to latch about said protruding opposite ends of said latching pin, an upper end on said control rod protruding from said control handle adapted to be actuated through descending movement so that said descending movement imparted thereto disengages said latching pin from said dustpan hook, and a spring seated beneath said lower end of said control rod so as to normally exert an upward spring bias thereagainst, whereby the weight of said laterally extended dustpan causes a pivotal traverse therein and provides said second position thereto, and the subsequent release of said control rod means causes the return thereof and of said latching pin to their original positions under spring urgency.

* * * * *